US006388951B1

(12) United States Patent
Matsumoto et al.

(10) Patent No.: US 6,388,951 B1
(45) Date of Patent: May 14, 2002

(54) AUDIO APPARATUS

(75) Inventors: Ryuichiro Matsumoto; Dai Ishikawa; Hidekazu Yoshida; Michiaki Hamada; Chiharu Akaishi, all of Tokyo (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/394,890

(22) Filed: Sep. 13, 1999

(30) Foreign Application Priority Data

Sep. 18, 1998 (JP) ..... 10-264562

(51) Int. Cl.[7] ..... G04B 23/02; G04B 19/24; G04C 21/00; G04C 19/00

(52) U.S. Cl. ..... 368/73; 368/29; 368/68; 368/82; 368/223

(58) Field of Search ..... 368/10, 29, 41–43, 368/68, 72–74, 82–84, 223–239

(56) References Cited

U.S. PATENT DOCUMENTS 4,362,392 A * 12/1982 Kumata ..... 368/82
5,365,494 A * 11/1994 Lynch ..... 368/10
5,861,797 A * 1/1999 Becker ..... 340/309.3
6,069,848 A * 5/2000 McDonald et al. ..... 368/107

* cited by examiner

*Primary Examiner*—Vit Miska
(74) *Attorney, Agent, or Firm*—Arent Fox Kintner Plotkin & Kahn, PLLC

(57) ABSTRACT

An audio apparatus comprises an internal clock capable of generating time data; a display section capable of displaying one form of information selected from several predetermined forms of information; and a controller capable of changing the selected information and enabling the selected information to be displayed on the display section, in accordance with the time data generated by the internal clock.

11 Claims, 9 Drawing Sheets

AUDIO APPARATUS

BACKGROUND OF THE INVENTION

The present invention relates to an audio apparatus, in particular to an audio apparatus containing an internal clock, having a display means capable of displaying various informations in accordance with time data generated by the internal clock device.

Conventionally, an audio apparatus has an internal clock which serves as a time data generating means capable of generating and indicating present time and date to be displayed on a display means and setting a scheduled date and time for starting or stopping an operation of the audio apparatus by means of a timer function.

However, in the above conventional audio apparatus, since the internal clock can only be used to indicate time and date and to serve as a timer, it has only limited functions which are not sufficient for use in an audio apparatus.

SUMMARY OF THE INVENTION

It is an object of the present invention to provide an improved audio apparatus having an improved display means capable of fully and more effectively using an internal clock and indicating various informations in accordance with the time data generated in the internal clock, so as to solve the above-mentioned problem peculiar to the above-discussed prior art.

According to the present invention, there is provided an audio apparatus which comprises an internal clock capable of generating time data; a display section capable of displaying one form of information selected from several predetermined forms of information; and a controller capable of changing the selected information and enabling the selected information to be displayed on the display section, in accordance with the time data generated by the internal clock.

In one aspect of the present invention, the selected information is a calender information indicating at least months and days, said controller is adapted to enable the calender information to be displayed on said display section in the form of either a static picture or a motion picture, all in accordance with the time data generated by the internal clock.

In another aspect of the present invention, the selected information is a response information to be displayed in accordance with the operation of a user on the audio apparatus. Further, the response information is controlled by the controller so as to be displayed on the display section, said response information serves as a response message which may be different due to different operations performed by a user in accordance with the time data generated by the internal clock.

In a further aspect of the present invention, the selected information is an information indicating an operation of the audio apparatus, said information is controlled by the controller so as to be displayed on the display section in different forms corresponding to different operations of the audio apparatus, in accordance with the time data generated by the internal clock.

The above objects and features of the present invention will become better understood from the following description with reference to the accompanying drawings.

DETAILED DESCRIPTION OF THE PREFERRED EMBODIMENTS

The description of the present invention will be based on an audio apparatus having a reproducing sect ion capable of reproducing audio signals from a recording/reproducing medium such as CD (compact disc), DVD (digital video disc or digital versatile disc) and MD (mini disc).

Figure 1:
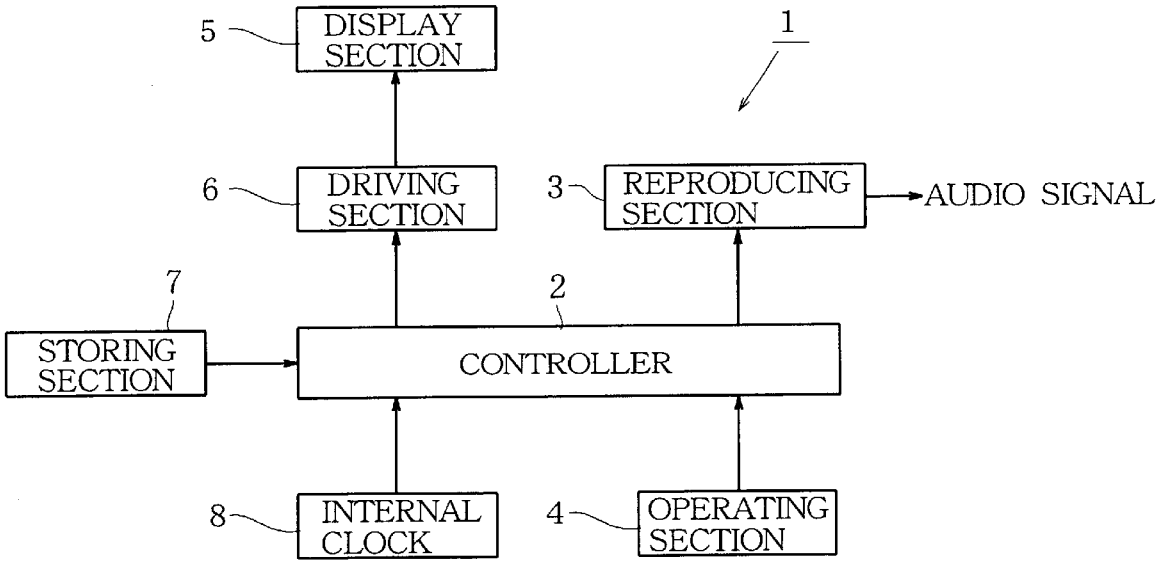
FIG. 1 is a block diagram indicating the constitution of an audio apparatus made according to the present invention.

FIG. 1 is a block diagram indicating the constitution of an audio apparatus 1 made according to the present invention.

As shown in FIG. 1, the audio apparatus 1 comprises a controller 2 for controlling the operation of the audio apparatus 1, a reproducing section 3 for reproducing audio signals from a recording/reproducing medium such as CD, DVD or MD, an operating section 4 provided for a user to give an instruction to the controller 2 for performing a desired operation, a display section 5, a driving section 6 for driving the display section 5, a storing section 7 comprising a ROM memory capable of storing a plurality of coded data to be displayed on the display section 5, and an internal clock 8.

The controller 2 has a micro-processor capable of controlling the whole operation of the audio apparatus 1 by executing a system program prepared in advance. In operation, the controller 2 can read data from the storing section 7 in accordance with a time data generated by the internal clock 8. The data read from the storing section 7 is fed to the display section 5 through the driving section 6, so as to be indicated on the display section 5 corresponding to the time data.

The operating section 4 includes an operating button which may be operated by a user for setting a timer function on the controller 2, a plurality of operating buttons adapted to send instructions to the reproducing section 3 for starting reproduction, stopping reproduction, effecting a high speed reproduction or effecting a pause. The operating section 4 further includes a change-over button for effecting a change-over between a displaying mode for the display section 5 to display present time and date and a displaying mode for the display section 5 to display other information.

The display section 5 is comprised of a liquid crystal display or a dot matrix type LED display or other types of display, all capable of being adjusted in their displaying brightness.

The driving section 6 is provided with a transistor array provided for electrically amplifying the signal level of data fed from the controller 2 so as to supply the data to the display section 5. The brightness of the display section 5 may be adjusted by controlling an electric power being supplied to the transistor array. By supplying the above data to the display section 5 in synchronism with a predetermined frame period, it is possible to display both a stationary picture where information is made stand still on the display and a moving picture where information is allowed to move on the display.

The operation of the audio apparatus 1 performed under the control of the controller 2 will be described in detail below with reference to the flowcharts shown in FIGS. 2 to 5.

The display operation of the audio apparatus 1 performed under the control of the controller 2 will be described in detail with reference to flowcharts shown in FIGS. 2 to 5.

Figure 2:
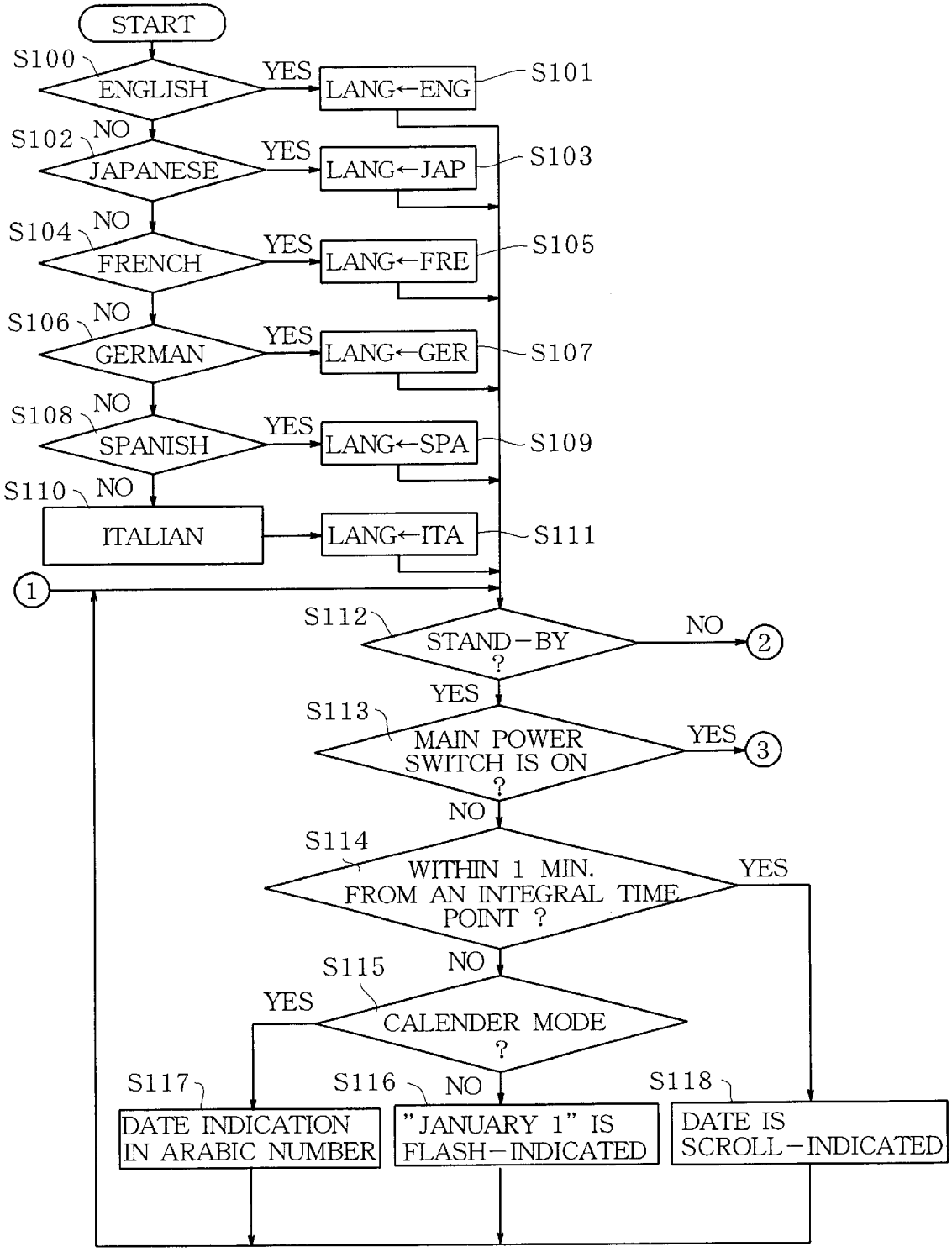
FIG. 2 is a flowchart indicating an operation for indicating calender information on the audio apparatus of the present invention.

Referring to FIG. 2, a user is allowed to operate on the operating section 4 to decide that information to be displayed on the display section 5 should be indicated in one of the listed languages including English, Japanese, French, German, Spanish and Italian. Soon after that, the controller 2 performs a determination at one of steps S100 to S111 to store a flag data indicating a designated language in a predetermined internal register LANG. For example, when it is required that the information to be displayed on the display section 5 is to be indicated in English, a corresponding determination is made at the step S100, thereby storing a flag data "ENG" meaning English in the internal register LANG.

Then, at a step S112, it is determined whether the audio apparatus 1 is in its stand-by state (i.e., its main power switch is ON, but its reproducing section 3 is not in operation). At this moment, if it is determined that the audio apparatus is in its stand-by state, the program goes to step S113. On the other hand, if it is determined at this moment that the audio apparatus 1 is not in its stand-by state, the program proceeds to a routine shown in FIG. 3.

At the step 113, it is determined whether the main power switch has been pushed so that the audio apparatus 1 is ON. If it is determined at the step 113 that the audio apparatus 1 is OFF, the program goes to a step 114. On the other hand, if it is determined that the audio apparatus 1 is ON, the program proceeds to a routine shown in FIG. 4.

In the present embodiment, the main power switch is formed by a push-pop type toggle switch which is so fabricated that once pushed during the apparatus's power-OFF state, the apparatus will be changed over to its power-ON state, and vise versa. In this way, by determining at the step 113 whether the main power switch has been pushed or not, it is allowed to determine what state the audio apparatus is in.

At a step 114, it is determined whether the time data generated in the internal clock 8 corresponds to a time point which is within one minute from an integral time point such as twelve noon, 1:00 pm, 2:00 pm, and 3: pm . . . . If an answer is NO, the program goes to a step S115, if YES the program goes to a step S118.

Figure 6A:
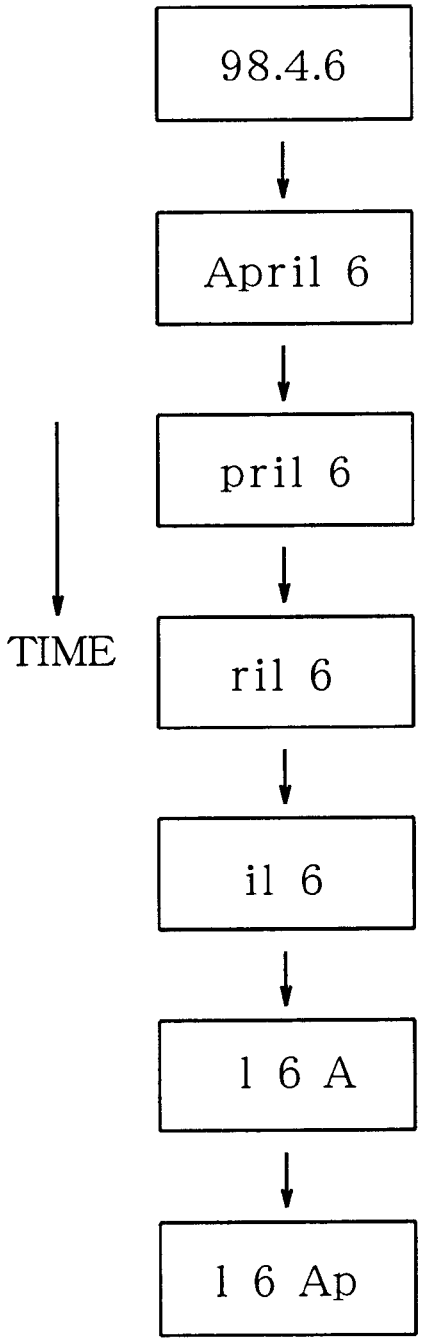
FIGS. 6A and 6B are explanatory views indicating how a calender information can be displayed on a display section of the audio apparatus of the present invention.
Figure 6B:
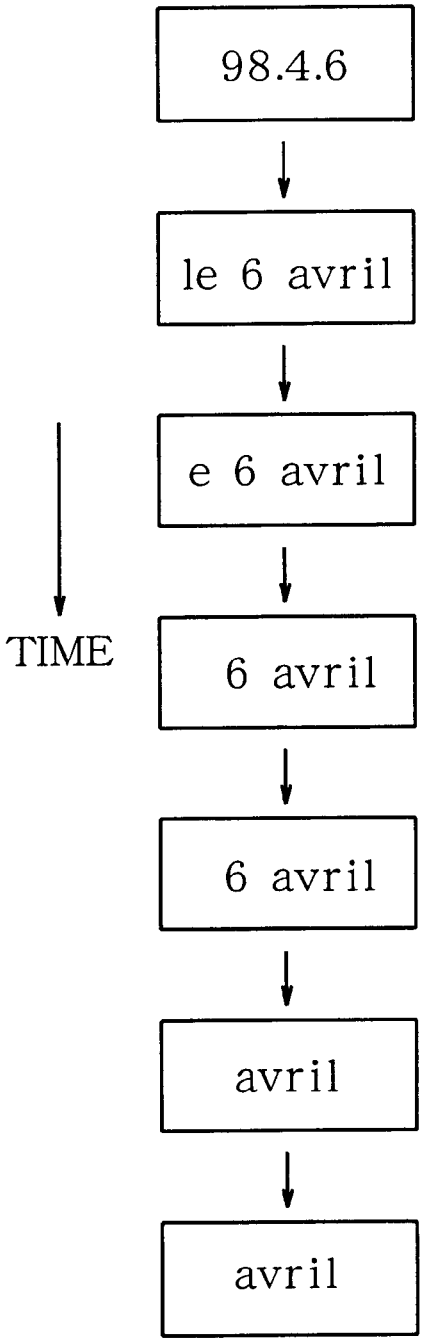

At the step 118, the flag data set in the internal resister LANG is referred, so that the present date may be scroll-indicated with the use of a language designated by the flag data. Namely, if English has been selected as a designated language, as shown in FIG. 6*a,* when the present time is not within one minute from an integral time point, the present date will be indicated to be a calender information such as "98. 4. 6" which is a static Arabic number. On the other hand, if the present time is within one minute from an integral time point, the present date will be indicated by the designated language (English) such as "April 6". Further, the calender information "April 6" will be moved gradually (one by one letter) from right to left in a predetermined period, thereby forming a motion scroll indication. On the other hand, if French has been selected as a designated language, the calender information will be scroll-indicated to be "le 6 avril".

At the step 115, it is determined whether a calender information indicating mode has been set by the user or not. If NO, the program goes to a step S116 at which a number "1.1" meaning "January 1" is flash-indicated, thereby requesting the user to set a present date.

On the other hand, if it is determined at the step 115 that the calender information indicating mode has already been set, the program goes to a step S117 at which the present date is indicated by Arabic number "98. 4. 6".

In this way, during a period the reproducing section 3 is not in its operation, the steps S112–S118 may be repeated so that a calender indication may be performed and at the same time said calender can be scroll-indicated, thereby indicating that the present time is at an integral time point.

Figure 3:
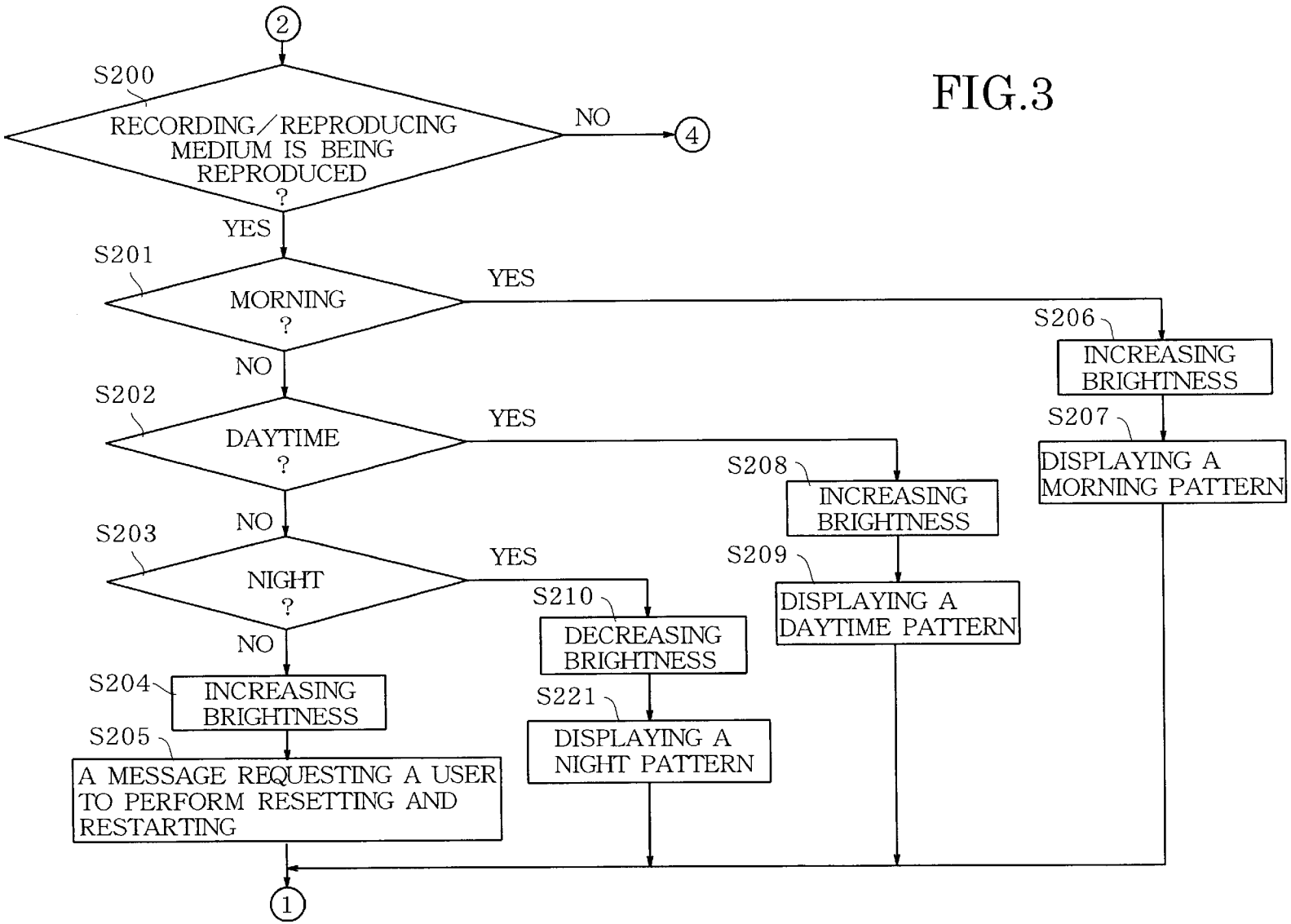
FIG. 3 is a flowchart indicating a display operation of the audio apparatus of the present invention, corresponding to different time periods.

FIG. 3 is used to explain a process which is needed when it is determined at the step 112 that the audio apparatus 1 is not in its stand-by state. As shown in FIG. 3, at first, it is determined at a step S200 whether a recording/reproducing medium has been set in the reproducing section 3 and whether it is being reproduced. If it is determined that the recording/reproducing medium is not in its process of being reproduced, the program proceeds to a routine shown in FIG. 5. On the other hand, if it is determined that the recording/reproducing medium is just being reproduced, the program goes to a step S201.

At steps 201–203, it is determined which of the morning period (4:00 am–9:59 am), daytime period (10:00 am–17:59 pm), and night period (4:00 pm–3:59 am) the present time belongs to.

Figure 7A:
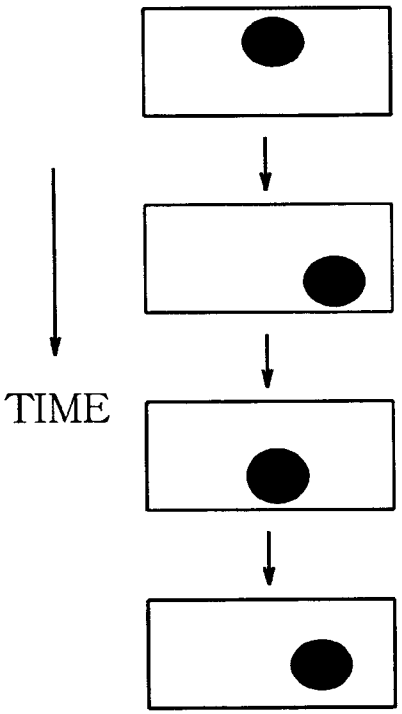
FIGS. 7A through 7C are explanatory views indicating how to display an image on a display section of the audio apparatus of the present invention, corresponding to different time periods.

If it is determined that the present time is in a morning period, the brightness of the display section 5 is increased at a step 206. For example, if the display section 5 is formed of a liquid crystal display, its brightness may be increased by increasing the illuminance of the backlight thereof. Then, at a step 207, an image of a morning is displayed in the form of a motion picture, thereby producing a display pattern where a small diameter ball-like image is actively jumping with a predetermined period, as shown in FIG. 7A.

Figure 7B:
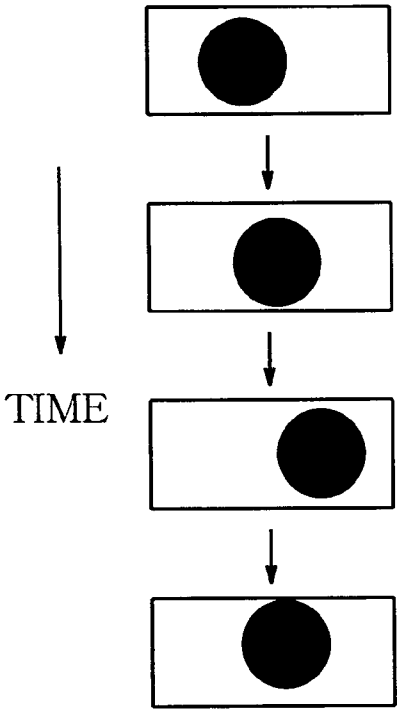

If it is determined that the present time is in a daytime period, the brightness of the display section 5 is increased at a step 208. Then, at a step 209, an image of a daytime is displayed in the form of a motion picture, thereby producing a display pattern where a ball-like image having a diameter larger than that in FIG. 7A is gently jumping with a predetermined period, as shown in FIG. 7B.

If it is determined that the present time is in a night period, the brightness of the display section 5 is decreased at a step 210. Then, at a step 221, an image of a night is displayed in the form of a motion picture, thereby producing a display pattern where a large diameter ball-like image is jumping more gently with a predetermined period, as shown in FIG.

Figure 7C:
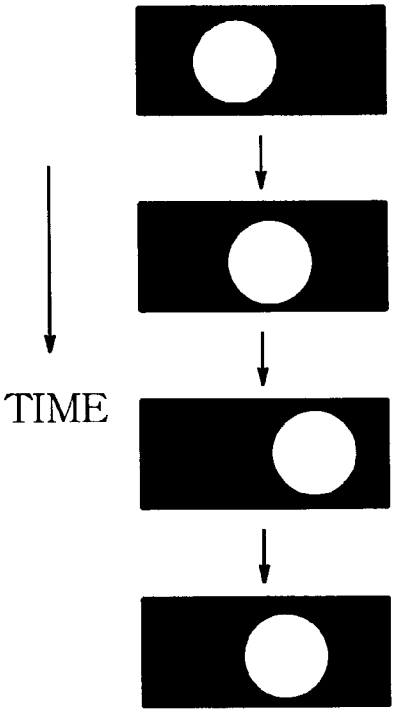

7C. Further, different from the cases of morning and daytime periods, the ball pattern is made bright and the background is made black, as shown in FIG. 7C.

Further, if at the steps 201 to 203 it is determined that the present time does not belong to any of the above morning, daytime, and night periods, or if the present data and time have not been re-set in advance on the internal clock 8 and a restart instruction has not been given, the brightness of the display section 5 will be increased at a step 204. Finally, at a step 205, a certain content is displayed on the display section 5 to ask the user to perform the above resetting and restarting.

In this way, when the reproducing section 3 is in its operation, i.e., when the audio apparatus 1 is in its actual operation, an operation data will be displayed so as to indicate that the reproducing section 3 is in operation. Further, since different patterns are displayed corresponding to different time periods such as morning, daytime and night, it has become possible to perform the indication corresponding to a user's activities in whole day.

On the other hand, if it is determined at the step 112 (FIG. 2) that the audio apparatus is in its stand-by state, and if it is determined at the step 113 that a power-OFF state has been changed over to a power-ON state, the operation of the audio apparatus may be explained with reference to a flowchart shown in FIG. 4.

Figure 4:
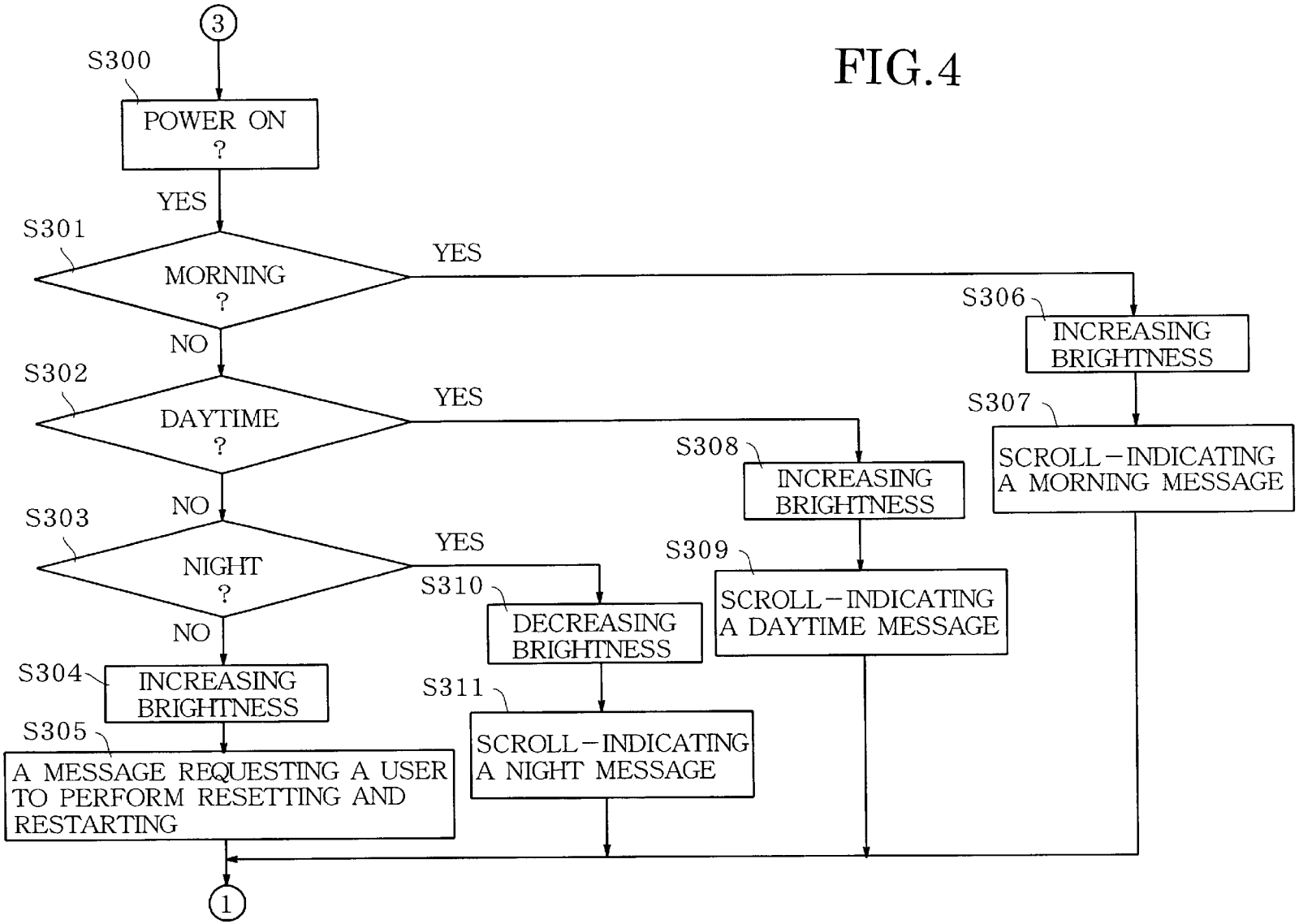
FIG. 4 is a flowchart indicating a display operation of the audio apparatus of the present invention, corresponding to different time periods.

As shown in FIG. 4, after the audio apparatus 1 has been set at a power-ON state (step 300), it is determined at steps 301 to 303 which of the morning, daytime, and night periods the present time belongs to.

Figure 8A:
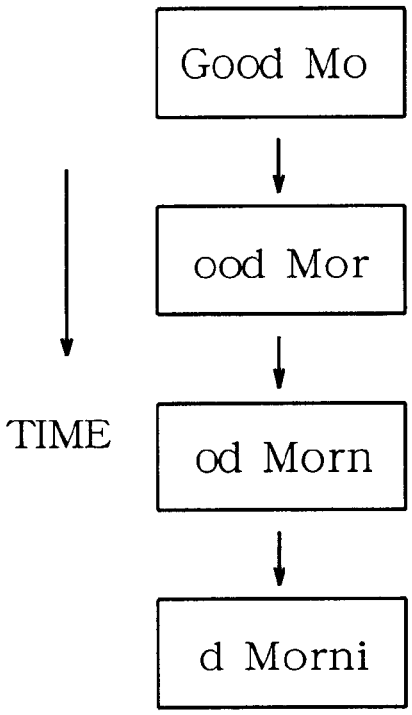
FIGS. 8A and 8B are explanatory views indicating how to display a message on a display section of the audio apparatus of the present invention, corresponding to different time periods.
Figure 8B:
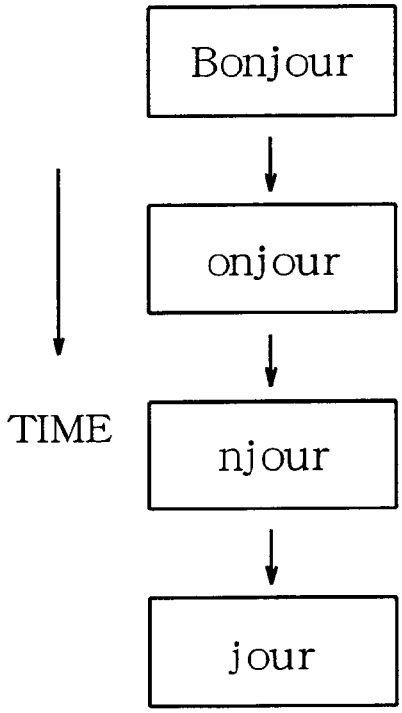

If it is determined at the step 301 that the present time in in morning period, the brightness of the display section 5 is increased at a step 306. Then, at the step 307, the flag data set in the internal resister LANG is referred, so that a greeting massage may be scroll-indicated with the use of a language designated by the flag data. Namely, if English has been selected as a designated language, as shown in FIG. 8A, a massage "Good morning" will be scroll-indicated by an indication moving gradually from right to the left with a predetermined period. On the other hand, if French is selected as a designated language, a massage "Bonjour" will be scroll-indicated by an indication moving gradually (one by one letter) from right to the left with a predetermined period, as shown in FIG. 8B.

If it is determined at the step 302 that the present time is in a daytime period, displaying brightness of the display section 5 is increased at a step 308. Then, at a step 309, a massage of greeting at daytime is scroll-displayed. Namely, if English has been selected as a designated language, a massage "Good afternoon" will be scroll-indicated by an indication moving gradually (one by one letter) from right to the left with a predetermined period.

If it is determined at a step 303 that the present time is in a night period, the brightness of the display section 5 is decreased at a step 310. Then, at a step 311, a message of greeting at night is scroll-displayed. Namely, if English has been selected as a designated language, a massage "Good evening" will be scroll-indicated by an indication moving gradually (one by one letter) from right to the left with a predetermined period.

Further, if at the steps 301 to 303 it is determined the present time does not belong to any of the above morning, daytime, and night periods, or if the present data and time have not been reset in advance on the internal clock 8 and a restart instruction has not been given, the brightness of the display section 5 will be increased at a step 304. Finally, at a step 305, a certain content is displayed on the display section 5 to request the user to perform the above resetting and restarting.

In this way, after the audio apparatus 1 has been changed over from its power-OFF state to its power-ON state, the apparatus itself will act like an expressive person capable of giving different greeting messages during different time periods.

Figure 5:
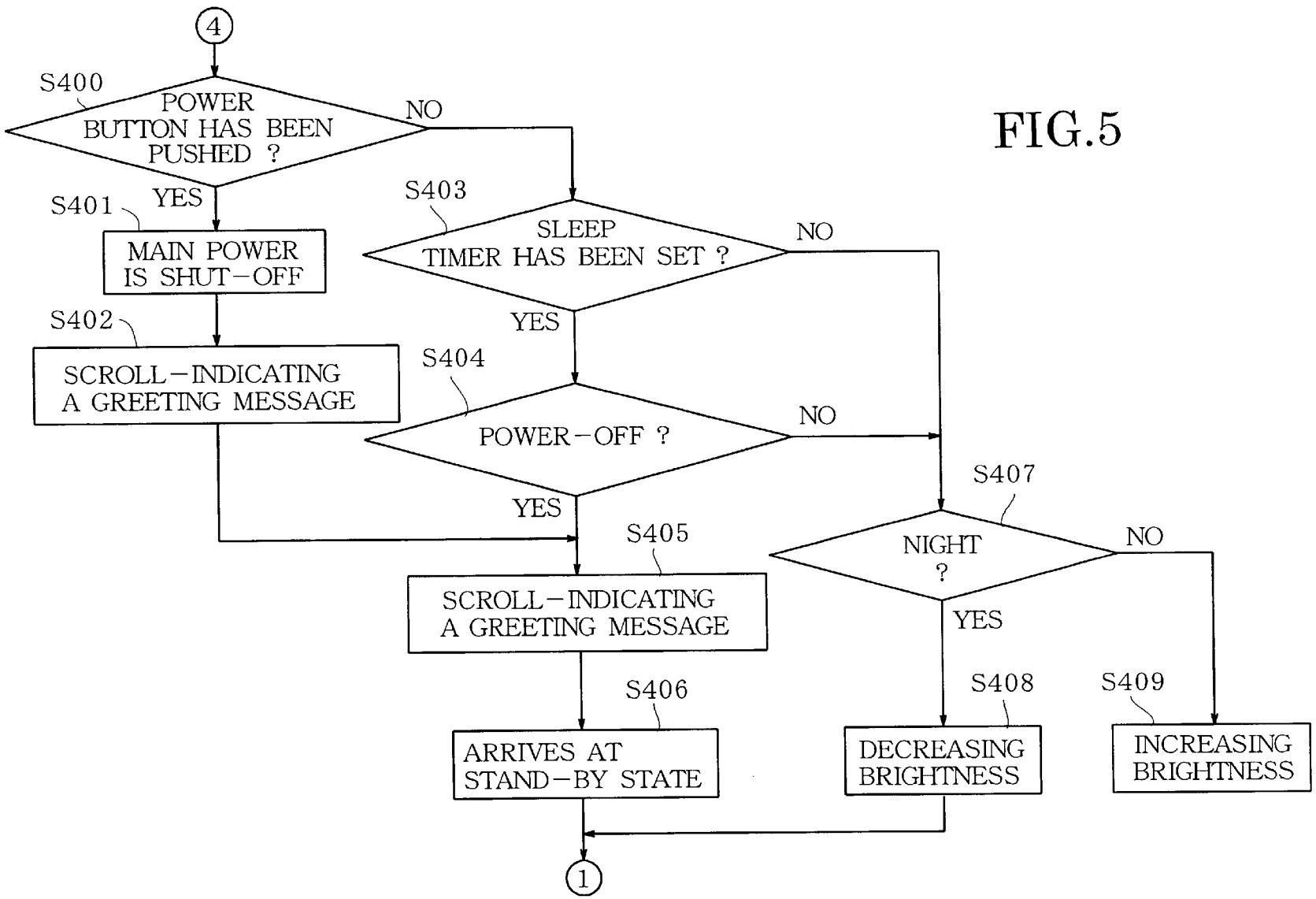
FIG. 5 is a flowchart indicating a display operation at the time of power-OFF on the audio apparatus of the present invention.

On the other hand, if it is determined at the step S200 (FIG. 3) that a recording/reproducing medium is not being reproduced by the reproducing section 3, the program proceeds to a routine indicated by a flow chart shown in FIG. 5.

Figure 9A:
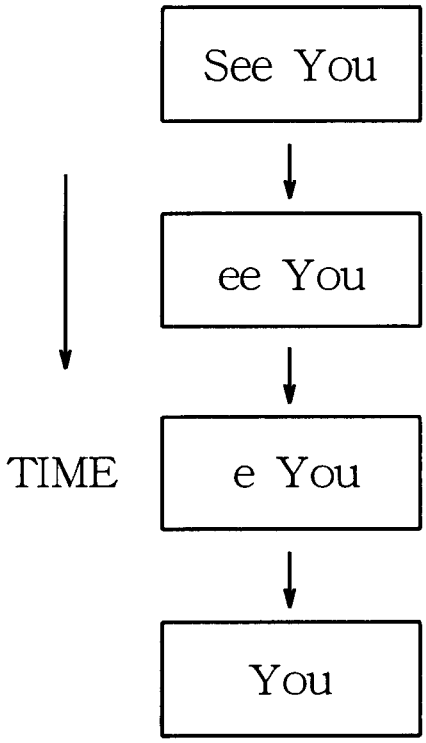
FIGS. 9A and 9B are explanatory views indicating how to display a message on a display section of the audio apparatus of the present invention, corresponding to different time periods.
Figure 9B:
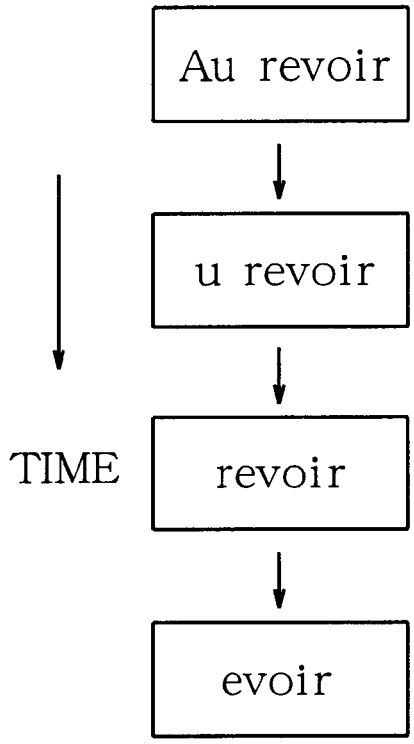

As shown in FIG. 5, it is determined at a step S400 whether a main power switch has been pushed down or not. If YES, it may be determined at a step S401 that the main power has been shut-off. Then, at a step S402, the flag data set in the internal resister LANG is referred, so that a greeting massage may be scroll-indicated with the use of a language designated by the flag data. Namely, if English has been selected as a designated language, as shown in FIG. 9A, a massage "See you" will be scroll-indicated by an indication moving gradually (one by one letter) from right to the left with a predetermined period. On the other hand, if French has been selected as a designated language, a massage "Au revoir" will be scroll-indicated by an indication moving gradually (one by one letter) from right to the left with a predetermined period.

Subsequently, at a step S406, the audio apparatus 1 arrives at a stand-by state which maintains only minimum necessary functions, and the program goes back to the step S112 (FIG. 2).

On the other hand, if it is determined at a step S400 that the main power switch has not been pushed down, it is determined at a step 403 whether a sleep timer function has bee set. If NO, it is determined at a step S407 whether the time data of the internal clock 8 belongs to a night time period (10:00 pm–3:59 pm). If YES, the brightness of the displaying section 5 is decreased at a step S408. If NO, the brightness of the display section 5 is increased at a step S409.

On the other hand, if it is determined at the step S403 that the sleep timer function has been set, then it is determined at a step S404 whether a time data of the internal clock 8 has arrived at a power-OFF time designated by the sleep timer function. Even after the present time has arrived at the power-off time, the brightness of the display section 5 may still be adjusted at the steps S408 and S409.

If it is determined at the step S404 that the timer data of the internal clock 8 has not arrived at a power-off time designated by the sleep timer function, at a step S405, the flag data set in the internal resister LANG is referred, so that a greeting massage may be scroll-indicated with the use of a language designated by the flag data. Namely, if English has been selected as a designated language, a massage "Good night" will be scroll-indicated by an indication moving gradually (one by one letter) from right to the left with a predetermined period.

As may be understood from the above description, with the use of the present invention, since time data generated by the internal clock may be used to provide various indications such as calender data, greeting messages and apparatus operating information, it is allowed to make full and more effective use of such an internal clock, thereby forming an improved displaying means capable of providing a user with various desired information and messages.

While the presently preferred embodiments of the this invention have been shown and described above, it is to be understood that these disclosures are for the purpose of illustration and that various changes and modifications may be made without departing from the scope of the invention as set forth in the appended claims.

What is claimed is:

1. An audio apparatus comprising:

an internal clock capable of generating time data;

a display means capable of displaying one form of information selected from several forms of information;

a control means capable of changing the selected information and enabling the selected information to be displayed on the display means, in accordance with the time data generated by the internal clock; and wherein the selected information can be changed to indicate the timeframe of the time data generated by the internal clock and so that when the selected information is changed the selected information remains related to the same subject matter.

2. The audio apparatus according to claim 1, wherein the selected information is a response information to be displayed in accordance with the operation of a user on the audio apparatus;

wherein the response information is controlled by the control means so as to be displayed on the display means, said response information serves as a response message which may be different due to different operations performed by a user in accordance with the time data generated by the internal clock.

3. The audio apparatus according to claim 1, wherein the selected information is an information indicating an operation of the audio apparatus, said information is controlled by the control means so as to be displayed on the display means in different forms corresponding to different operations of the audio apparatus, in accordance with the time data generated by the internal clock.

4. An audio apparatus comprising:

an internal clock capable of generating time data;

a display means capable of displaying one form of information selected from several forms of information;

a control means capable of changing the selected information and enabling the selected information to be displayed on the display means, in accordance with the time data generated by the internal clock; and wherein said selected information is a calendar information indicating at least months and days, said control means is adapted to enable the calendar information to be displayed on said display means in the form of either a static picture or a motion picture, all in accordance with the time data generated by the internal clock.

5. An audio apparatus comprising:

an internal clock capable of generating time data;

a display means capable of selectively displaying information selected from several predetermined forms of information;

a control means capable of changing the selected information and enabling the selected information to be displayed on the display means, in accordance with the time data generated by the internal clock; and wherein the selected information can be changed to indicate the timeframe of the time data generated by the internal clock and so that when the selected information is changed the selected information remains related to the same subject matter.

6. An audio apparatus comprising:

an internal clock capable of generating time data;

a display means capable of displaying one form of information selected from several forms of information;

a control means capable of changing the selected information and enabling the selected information to be displayed on the display means, in accordance with the time data generated by the internal clock; and wherein the selected information can be automatically adjusted periodically by the control means to represent one of several timeframes in response to the time data generated by the internal clock and so that when the selected information is changed the selected information remains related to the same subject matter.

7. An audio apparatus comprising:

an internal clock capable of generating time data;

a display means capable of selectively displaying information selected from several predetermined forms of information;

a control means capable of changing the selected information and enabling the selected information to be displayed on the display means, in accordance with the time data generated by the internal clock; and wherein the selected information can be automatically adjusted periodically by the control means to represent one of several timeframes in response to the time data generated by the internal clock and so that when the selected information is changed the selected information remains related to the same subject matter.

8. An audio apparatus comprising:

an internal clock capable of generating time data;

a display device capable of displaying one form of information selected from several forms of information; and a control device capable of changing the selected information and enabling the selected information to be displayed on the display device, in accordance with the time data generated by the internal clock;

wherein said selected information is a calendar information indicating at least months and days, said control device is adapted to enable the calendar information to be displayed on said display device in the form of either a static picture or a motion picture, all in accordance with the time data generated by the internal clock; and wherein the selected information can be changed to indicate the timeframe of the time data generated by the internal clock and so that when the selected information is changed the selected information remains related to the same subject matter.

9. The audio apparatus according to claim 8, wherein the selected information is a response information to be displayed in accordance with the operation of a user on the audio apparatus;

wherein the response information is controlled by the control device so as to be displayed on the display device, said response information serves as a response message which may be different due to different operations performed by the user in accordance with the time data generated by the internal clock.

10. The audio apparatus according to claim 8, wherein the selected information is an information indicating an operation of the audio apparatus, said information is controlled by the control device so as to be displayed on the display device in different forms corresponding to different operations of the audio apparatus, in accordance with the time data generated by the internal clock.

11. An audio apparatus comprising:

an internal clock capable of generating time data;

a display device capable of selectively displaying information selected from several predetermined forms of information; and a control device capable of changing the selected information and enabling the selected information to be displayed on the display device, in accordance with the time data generated by the internal clock; and wherein the selected information can be changed to indicate the timeframe of the time data generated by the internal clock and so that when the selected information is changed the selected information remains related to the same subject matter.

* * * * *